US009283788B2

(12) United States Patent
Shimamoto

(10) Patent No.: US 9,283,788 B2
(45) Date of Patent: Mar. 15, 2016

(54) IMAGE FORMING DEVICE

(71) Applicant: MURATA MACHINERY, LTD., Kyoto-shi, Kyoto (JP)

(72) Inventor: Hideatsu Shimamoto, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 472 days.

(21) Appl. No.: 13/687,597

(22) Filed: Nov. 28, 2012

(65) Prior Publication Data

US 2013/0194369 A1 Aug. 1, 2013

(30) Foreign Application Priority Data

Jan. 27, 2012 (JP) ..... 2012-015004

(51) Int. Cl.

| | |
|---|---|
| ***B41J 2/45*** | (2006.01) |
| ***B41J 2/47*** | (2006.01) |
| ***B41J 25/308*** | (2006.01) |
| ***G03G 15/04*** | (2006.01) |
| ***G03G 21/16*** | (2006.01) |

(52) U.S. Cl.

CPC *B41J 25/308* (2013.01); *B41J 2/45* (2013.01); *B41J 2/47* (2013.01); *G03G 15/04* (2013.01); *G03G 15/04045* (2013.01); *G03G 21/1633* (2013.01); *G03G 21/1666* (2013.01)

(58) Field of Classification Search

CPC ..... B41J 2/45; B41J 2/47; B41J 25/308

See application file for complete search history.

(56) References Cited

U.S. PATENT DOCUMENTS

| | | | | |
|---|---|---|---|---|
| 2007/0115340 | A1* | 5/2007 | Tanabe | 347/130 |
| 2008/0145103 | A1* | 6/2008 | Honobe et al. | 399/205 |
| 2009/0169245 | A1 | 7/2009 | Sato | 399/111 |
| 2011/0299873 | A1* | 12/2011 | Ushiozu et al. | 399/90 |
| 2012/0114374 | A1 | 5/2012 | Suzuki | 399/111 |
| 2013/0170855 | A1* | 7/2013 | Mori | G03G 15/0189 399/110 |

FOREIGN PATENT DOCUMENTS

| | | | |
|---|---|---|---|
| JP | 2000-293085 | A | 10/2000 |
| JP | 2006-018126 | | 1/2006 |
| JP | 2006-018127 | | 1/2006 |
| JP | 2007-086482 | | 4/2007 |
| JP | 2007-140392 | | 6/2007 |
| JP | 2008-134395 | A | 6/2008 |
| JP | 2009-009119 | | 1/2009 |
| JP | 2009-122391 | A | 6/2009 |
| JP | 2009-294407 | A | 12/2009 |
| JP | 2010-014806 | A | 1/2010 |
| JP | 2011-070142 | | 4/2011 |

* cited by examiner

*Primary Examiner* — Kristal Feggins
*Assistant Examiner* — Kendrick Liu
(74) *Attorney, Agent, or Firm* — DLA Piper LLP (US)

(57) ABSTRACT

An image forming device includes a fixed frame, a slide frame, a head supporting frame, a cam structure, and an operation body. The fixed frame is arranged adjacent to a photosensitive body. The slide frame is supported in a slidable manner along a first axis line by the fixed frame. The head supporting frame is supported in a slidable manner along a second axis line, which intersects the first axis line, by the fixed frame, and supports an exposure head. The cam structure converts an operation in which the slide frame slides to an operation in which the head supporting frame slides. The operation body moves the exposure head between a separated position and a proximate position by sliding the slide frame.

16 Claims, 11 Drawing Sheets

IMAGE FORMING DEVICE

CROSS-REFERENCE TO RELATED APPLICATIONS

This application claims priority under 35 U.S.C. 119 to Japanese Patent Application No. 2012-015004, filed on Jan. 27, 2012, which application is hereby incorporated by reference in its entirety.

BACKGROUND OF THE INVENTION

1. Field of the Invention

The present invention relates to an image forming device including an exposure head for forming a latent image on a photosensitive body (photosensitive drum or photosensitive belt).

2. Description of Related Art

Conventionally, there is known an image forming device in which the exposure head is moved to a proximate position from a separated position with respect to a photosensitive drum using an opening/closing operation of a front door. The exposure head is supported with a frame body so as to be brought into proximity to or separated from the photosensitive drum, and is biased towards the separated position with a spring. The frame body includes an operation lever for moving the exposure head against the biasing force of the spring, and the operation lever tilts the exposure head through an interlocking structure using the opening/closing operation of the front door. The interlocking structure is configured by an operation projection arranged on an inner surface of the front door, an operation arm oscillation operated about a perpendicular axis with the operation projection, a wire for transmitting the oscillation operation of the operation arm to the operation lever, a direction changing pulley for guiding the wire while changing the direction and the like.

According to the moving structure of the exposure head described above, the attachment of toner scattered from a developing unit or the photosensitive drum on a light emitting surface of the exposure head can be resolved by moving the exposure head to the separated position away from the photosensitive drum in cooperation with the operation of opening the front door. Furthermore, since the exposure head returns to the proximate position in cooperation with the operation of closing the front door, the trouble of manually returning the exposure head to the proximate position after replacing the device can be omitted. However, the operation projection, the operation arm, the wire, the guide pulley, and the like are required to be arranged between the operation lever and the front door as a structure for operating the exposure head, and hence the overall structure is complex, the number of components is large, and increase in cost is inevitable. Furthermore, it is necessary to ensure a space for arranging each member mentioned above at the periphery of the exposure head and the developer.

BRIEF SUMMARY OF THE INVENTION

An object of the present invention is to provide an image forming device capable of simplifying a head moving structure of operating movement of an exposure head between a proximate position and a separated position, thereby reducing cost.

An image forming device according to one embodiment of the present invention includes a fixed frame, a slide frame, a head supporting frame, a cam structure, and an operation body. The fixed frame is arranged adjacent to a photosensitive body. The slide frame is supported in a slidable manner along a first axis line by the fixed frame. The head supporting frame is supported in a slidable manner along a second axis line, which intersects the first axis line, by the fixed frame, and supports an exposure head. The cam structure converts an operation in which the slide frame slides along the first axis line to an operation in which the head supporting frame slides along the second axis line. The operation body moves the exposure head supported by the head supporting frame between a separated position and a proximate position with respect to the photosensitive body by sliding the slide frame.

The image forming device according to the present invention may be further configured such that the operation body is a toner container attached in a freely attaching and detaching manner to a chassis. The toner container moves the exposure head between the separated position and the proximate position by sliding the slide frame by being attached or detached.

The image forming device according to the present invention may be further configured such that the operation body is a door supported in a freely opening or closing manner by a chassis. The door moves the exposure head between the separated position and the proximate position by sliding the slide frame by being opened or closed.

The image forming device according to the present invention may further include a first biasing member and a second biasing member. The first biasing member is arranged between the fixed frame and the head supporting frame to bias the head supporting frame towards the separated position. The second biasing member is arranged between the fixed frame and the slide frame. The second biasing member biases the slide frame towards the operation body such that one part of the slide frame advances into an attachment region of the toner container in a state where the toner container is detached from the chassis.

The image forming device according to the present invention may be further configured such that the exposure head includes a lens array and an LED (light emitting diode) light source, and a head base for supporting both the lens array and the LED light source. The head base is supported on a side facing the photosensitive body in the head supporting frame. A positioning structure is arranged on opposing surfaces of a supporting frame for supporting the photosensitive body and the head base to position the exposure head with respect to the photosensitive body at the proximate position by being engaged.

The image forming device according to the present invention may further include a holding structure arranged between the toner container and the chassis to hold an attached state of the toner container. The holding structure includes a first engagement body and a second engagement body. The first engagement body is arranged on the toner container side, and the second engagement body is arranged on the chassis side. Any one of the first engagement body and the second engagement body is involved and dropped out while elastically deforming with respect to the other engagement body.

The image forming device according to the present invention may be further configured such that the cam structure is arranged between the slide frame and the head supporting frame.

The image forming device according to the present invention may be further configured such that the cam structure includes an operation cam arranged in a projecting manner on the slide frame, and a passive cam arranged in a projecting manner on the head supporting frame. When the exposure head is at the separated position, a projecting end of the operation cam is arranged proximate to the head supporting frame, and a projecting end of the passive cam is received by the slide frame continuing to a basal end of the operation cam.

The image forming device according to the present invention may be further configured such that the operation cam is provided with an inclined surface inclined with respect to the first axis line. The passive cam is provided with an inclined surface inclined with respect to the second axis line. The exposure head moves between the separated position and the proximate position with the respective inclined surfaces of the operation cam and the passive cam brought into contact with each other.

The image forming device according to the present invention may further include a door and a drum unit. The door is supported in a feely opening/closing manner by the chassis. The drum unit is attached to the chassis in a freely attaching and detaching manner so as to be arranged close to the door side than the toner container. The drum unit includes a photosensitive drum serving as a photosensitive body, a drum supporting frame, and a positioning shaft. The drum supporting frame supports the photosensitive drum. The positioning shaft positions the exposure head with respect to the photosensitive drum at the proximate position.

The image forming device according to the present invention may further include a third biasing member that biases the exposure head towards the photosensitive body.

The image forming device according to the present invention may be further configured such that the head supporting frame includes a housing for supporting the head base in a freely sliding manner.

An image forming device according to another embodiment of the present invention includes a fixed frame, a slide frame, a head supporting frame, a cam structure, and an operation body. The fixed frame is arranged adjacent to a photosensitive body. The slide frame is supported in a slidable manner along a first axis line by the fixed frame. The head supporting frame is supported in a slidable manner along a second axis line, which intersects the first axis line, by the fixed frame, and supports an exposure head. The cam structure is arranged between the slide frame and the head supporting frame to convert an operation in which the slide frame slides along the first axis line to an operation in which the head supporting frame slides along the second axis line. The operation body moves the exposure head supported by the head supporting frame from one side to the other side of a separated position and a proximate position with respect to the photosensitive body by sliding the slide frame.

The image forming device according to the present invention may be further configured such that the operation body is a toner container attached in a freely attaching and detaching manner to a chassis. The toner container moves the exposure head from one side to the other side of the separated position and the proximate position by sliding the slide frame by being attached or detached.

An image forming device according to a further embodiment of the present invention includes a fixed frame, a slide frame, a head supporting frame, an operation cam, a passive cam, and an operation body. The fixed frame is arranged adjacent to a photosensitive body. The slide frame is supported in a slidable manner along a first axis line by the fixed frame. The head supporting frame is supported in a slidable manner along a second axis line, which intersects the first axis line, by the fixed frame, and supports an exposure head. The passive cam is arranged in a projecting manner on the head supporting frame. The operation cam is arranged in a projecting manner on the slide frame and brought into contact with the passive cam. The operation body changes a contacting mode of the operation cam and the passive cam by sliding the slide frame, and moves the exposure head supported by the head supporting frame from one side to the other side of a separated position and a proximate position with respect to the photosensitive body by changing the contacting mode.

The image forming device according to the present invention may be further configured such that the operation body is a toner container attached in a freely attaching and detaching manner to a chassis. The toner container moves the exposure head from one side to the other side of the separated position and the proximate position by sliding the slide frame by being attached or detached.

The image forming device according to the present invention may further include a first biasing member and a second biasing member. The first biasing member is arranged between the fixed frame and the head supporting frame to bias the head supporting frame in a direction away from the photosensitive body. The second biasing member is arranged between the fixed frame and the slide frame. The second biasing member biases the slide frame towards the operation body such that one part of the slide frame advances into an attachment region of the toner container in a state where the toner container is detached from the chassis.

Other features, elements, processes, steps, characteristics and advantages of the present invention will become more apparent from the following detailed description of embodiments of the present invention with reference to the attached drawings.

DETAILED DESCRIPTION OF THE INVENTION

FIGS. 1-9 illustrate an embodiment in which a head moving structure of an image forming device according to the present invention is applied to a multifunction peripheral having a copy function and a facsimile function. Front and back, left and right, and up and down directions in the present invention are as indicated with cross arrows in FIGS. 2 and 4. The front and back direction and the left and right direction are directions in a horizontal plane, and the up and down direction is defined as a vertical direction. The front and back direction is parallel to a rotation axis (a first axis line 22A, or sliding direction of a slide frame 22) of a photosensitive drum 9, and the left and right direction is parallel to a second axis line 23A (sliding direction of a head supporting frame 23).

Figure 2:
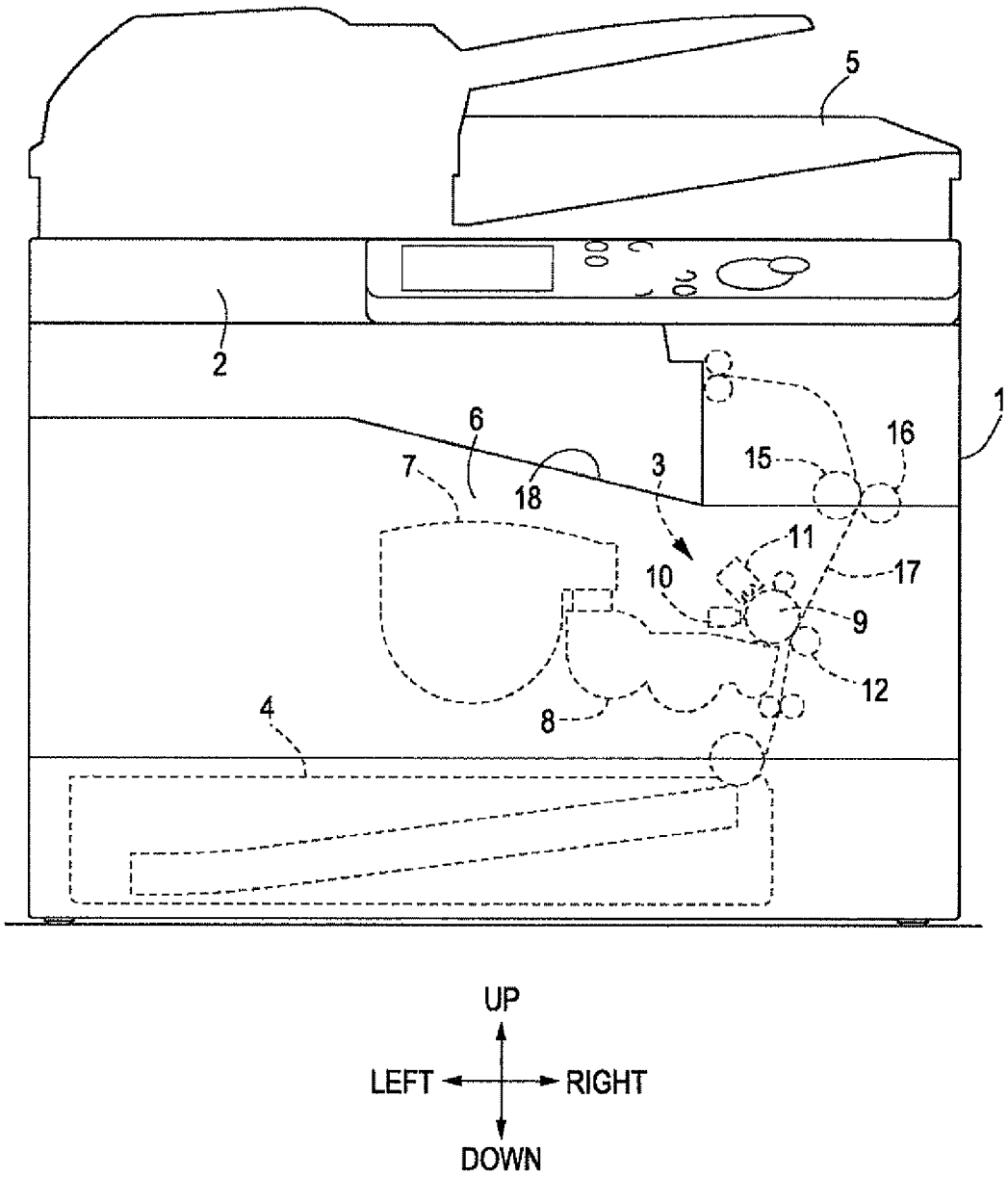
FIG. 2 is a front view of the image forming device (multifunction peripheral) according to the embodiment of the present invention.

The multifunction peripheral in FIG. 2 includes an image scanning unit 2 arranged on an upper side of a main body 1, an image forming unit 3 arranged closer to one side of the main body 1, a paper feed cassette 4 arranged on a lower side of the image forming unit 3, and the like. The image scanning unit includes a fixed document scanning device and an automatic document scanning device incorporated in a platen cover 5 to continuously scan sheets of documents.

The image forming unit 3 is configured by a recording unit and a fuser unit. The recording unit is configured by a toner cartridge 7, a developing unit 8, the photosensitive drum 9, an exposure head 10 and a charging device 11 for forming an electrostatic latent image with respect to the photosensitive drum 9, a transfer roller 12, and the like. A waste toner box (toner container) 13 is arranged at a front end of the toner cartridge 7 (see FIG. 1). The fuser unit is configured by a heating roller 15 including a heat source, a pressure roller 16 biased towards the heating roller 15, and the like. A recording paper fed from the paper feed cassette 4 is fed to the recording unit through a transportation path 17, toner is transferred while passing between the photosensitive drum 9 and the transfer roller 12, and the toner is fused while being passed between the heating roller 15 and the pressure roller 16. The recording paper fused with an image is then discharged to a paper discharging unit 18 at a lower side of the image scanning unit 2.

The toner cartridge 7 and the waste toner box 13, and the developing unit 8 are attached and detached by being slid in the front and back direction from the front side of the machine body with respect to respective attachment portions of the main body 1 by opening a front door 6 covering the front surface of the image forming unit 3. The front door (door) 6 is supported by a chassis 20 in an openable/closable manner about a shaft of a hinge arranged at a lower end of the front door 6. The front door 6 can change from a closed position of covering the front surface of the image forming unit 3 in an upright state to an opened position of opening the front surface of the image forming unit 3 by being tilted towards the front side of the main body 1. The front door 6 at the closed position is locked by a lock structure arranged in the main body 1, and is opened by releasing the lock state.

Figure 3:
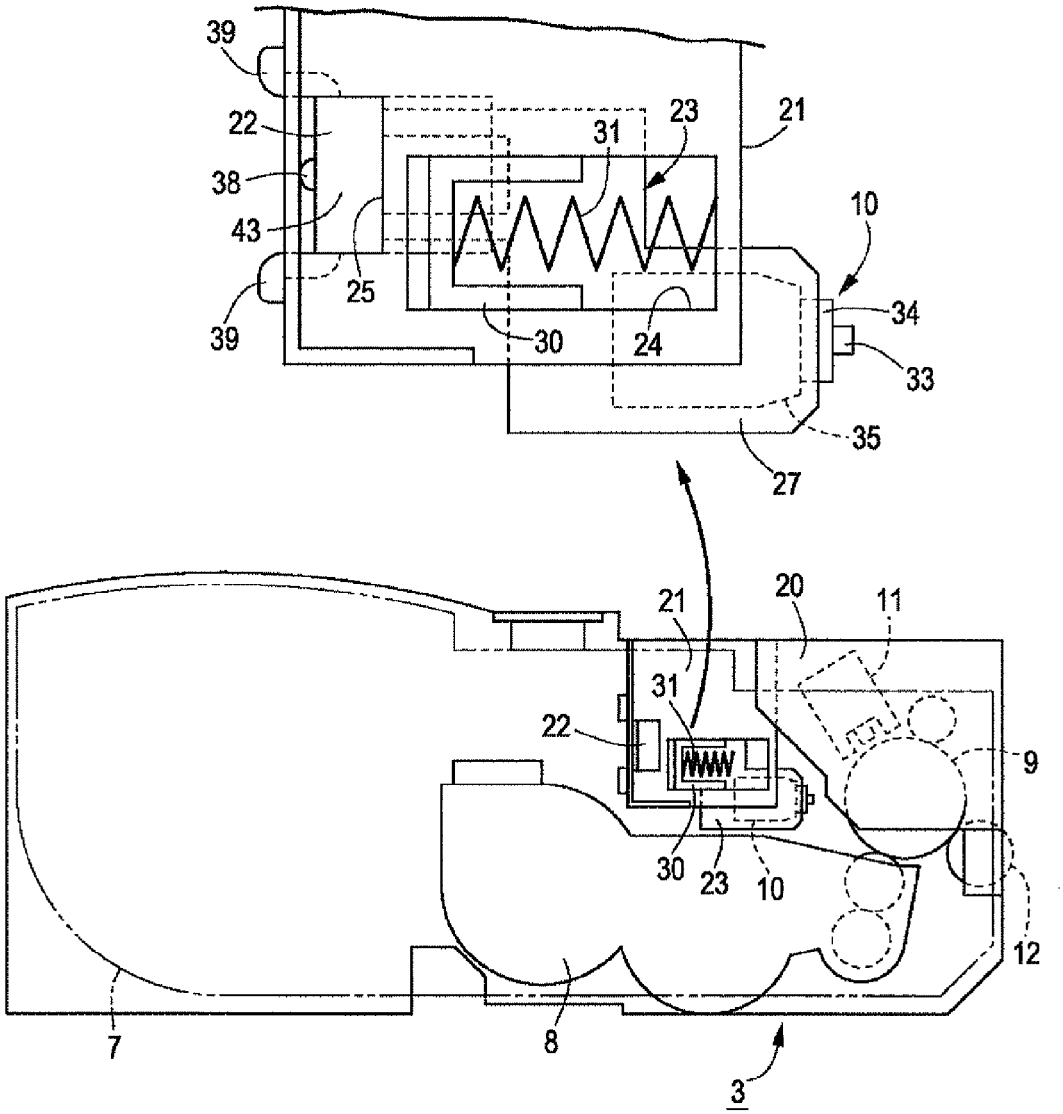
FIG. 3 is a front view illustrating a schematic structure of an image forming unit in the embodiment of the present invention.
Figure 4:
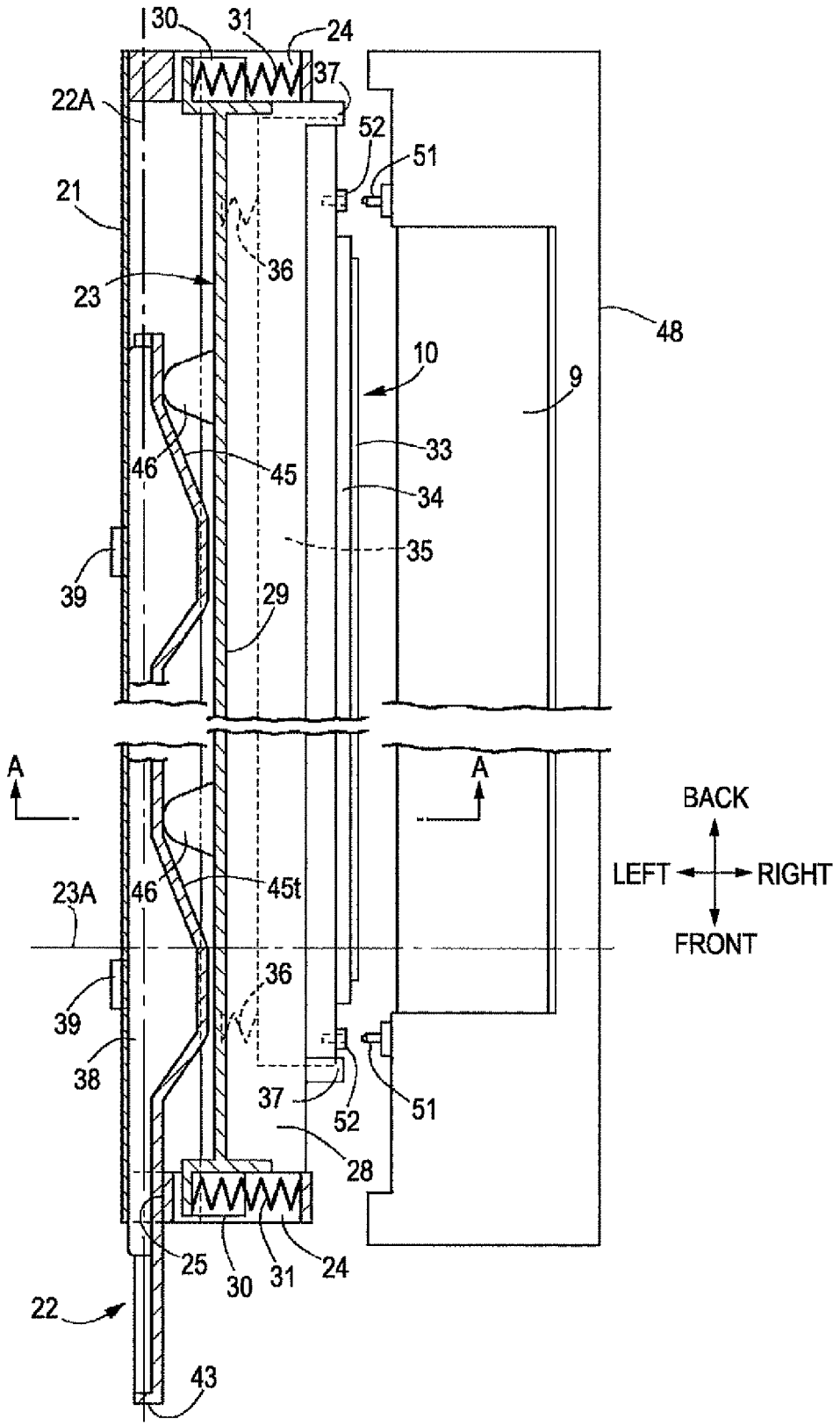
FIG. 4 is a plan view of a head moving structure in a state where an exposure head is at a separated position in the embodiment of the present invention.
Figure 5:
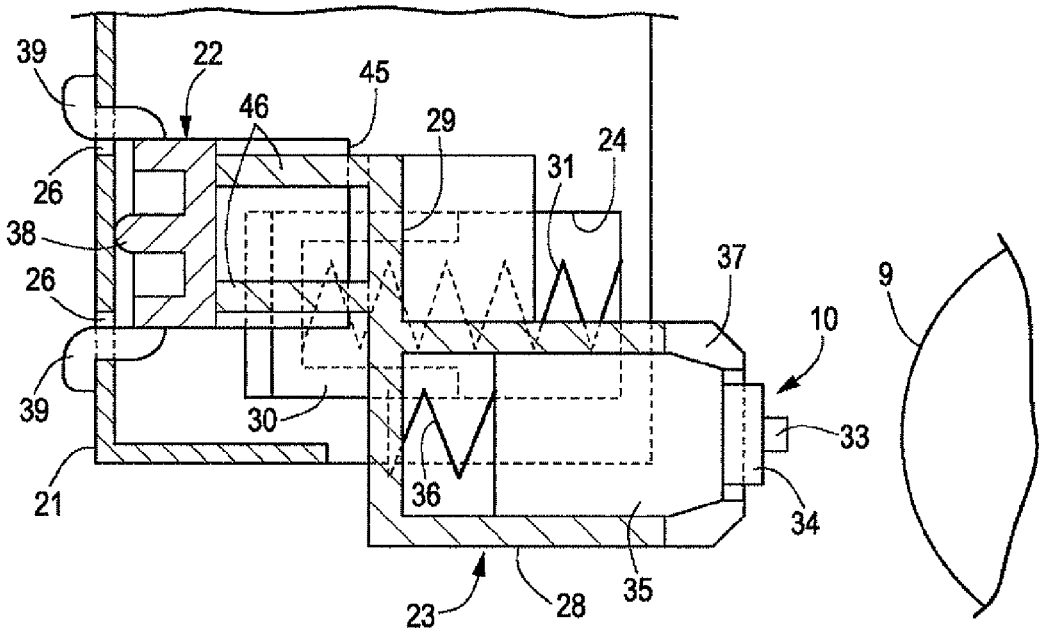
FIG. 5 is a cross-sectional view taken along line A-A in FIG. 4.
Figure 6:
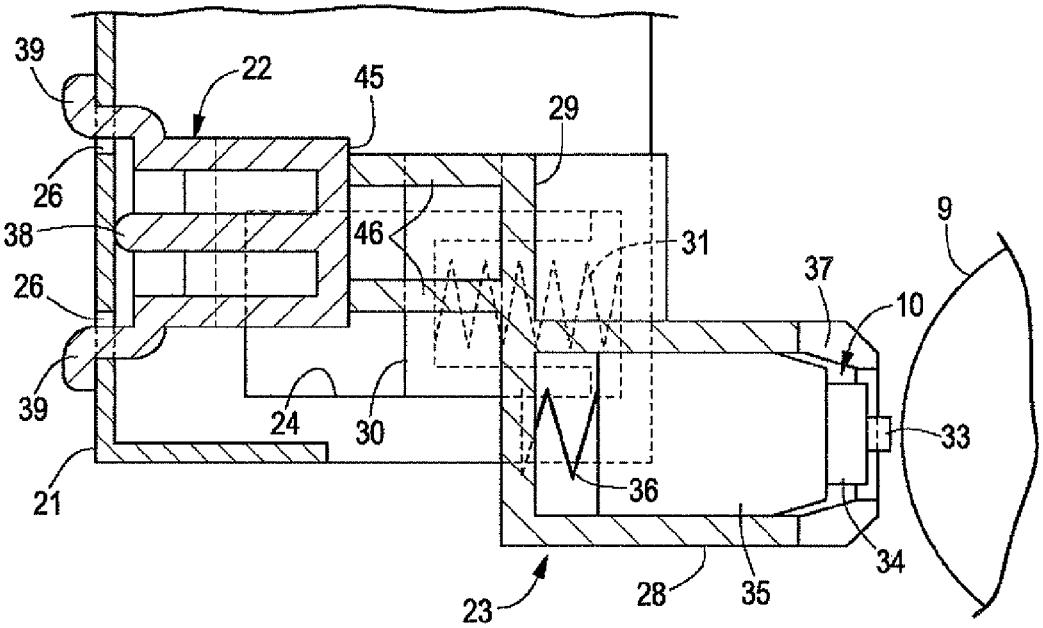
FIG. 6 is a cross-sectional view taken along line B-B in FIG. 8.

The head moving structure is arranged on one side in the vicinity of the photosensitive drum 9. In cooperation with the attaching and detaching operation of the toner cartridge 7 and the waste toner box 13, the head moving structure is displaced between a proximate position at which the exposure head 10 is proximate to a peripheral surface of the photosensitive drum 9, and a separated position at which the exposure head 10 is distant from the photosensitive drum 9. In FIGS. 3 and 4, the head moving structure includes a fixed frame fixed to the chassis 20, and a slide frame 22 slidably supported by the fixed frame 21 along a first axis line 22A (front and back direction). Furthermore, the head moving structure includes a head supporting frame 23 slidably supported by the fixed frame 21 along a second axis line 23A (direction orthogonal to the slide frame 22) that intersects the first axis line 22A, a cam structure for carrying out an operation conversion, an operation body 27 for pushing the slide frame 22, and the like. In this embodiment, the waste toner box 13 is used as the operation body 27.

The fixed frame 21 is a square box-shaped plastic molded article opened towards the photosensitive drum 9. A head guiding groove 24 for guiding the head supporting frame 23 in a freely sliding manner to the left and the right is formed on each of the front end wall and the back end wall of the fixed frame 21. A slide window 25 for guiding the slide frame 22 in a freely entering and exiting manner is opened adjacent to the head guiding groove 24 in the front end wall of the fixed frame. A frame guiding groove 26 for guiding the slide frame 22 in a freely sliding manner to the front and the back is formed at the top and bottom of the left side wall of the fixed frame 21 (see FIG. 5).

The head supporting frame 23 integrally includes a housing 28 opened towards the photosensitive drum 9, a cam base arranged projecting upward from an upper corner of the housing 28, and a slide arm 30 arranged at front and back ends of the housing 28 and the cam base 29. The slide arm 30 is supported by the head guiding groove 24 and can slidably move in the left and right direction. A first spring 31 (biasing member) of a compression coil type for biasing the head supporting frame 23 in a direction away from the photosensitive drum 9 is arranged between the front and back slide arms 30 and the head guiding groove 24. By incorporating the exposure head inside the housing 28, the exposure head 10 is integrated with the head supporting frame 23.

The exposure head 10 is configured by a lens array 33, which is long in the front and back direction and configured by a group of gradient index rod lenses, an LED light source 34, and a head base 35 for supporting the lens array 33 and the LED light source 34. The lens array 33 images light irradiated from the LED light source 34 on the surface of the photosensitive drum 9 to form an electrostatic latent image based on the image data scanned with the image scanning unit 2. When the head base is guided in a freely sliding manner to the left and the right in the housing 28, the exposure head 10 can reciprocate between the proximate position and the separated position accompanying the head supporting frame 23. A third spring 36 (biasing member) of a compression coil type is arranged (see FIG. 4) at two areas on the front and back between the head base 35 and an inner far part of the housing 28, and the exposure head 10 is biased in a direction of advancing towards the photosensitive drum 9 by the third spring 36. A stopper wall 37 is arranged at the front and back ends of the housing 28 to define a limit point for the advancement of the exposure head 10.

Figure 1:
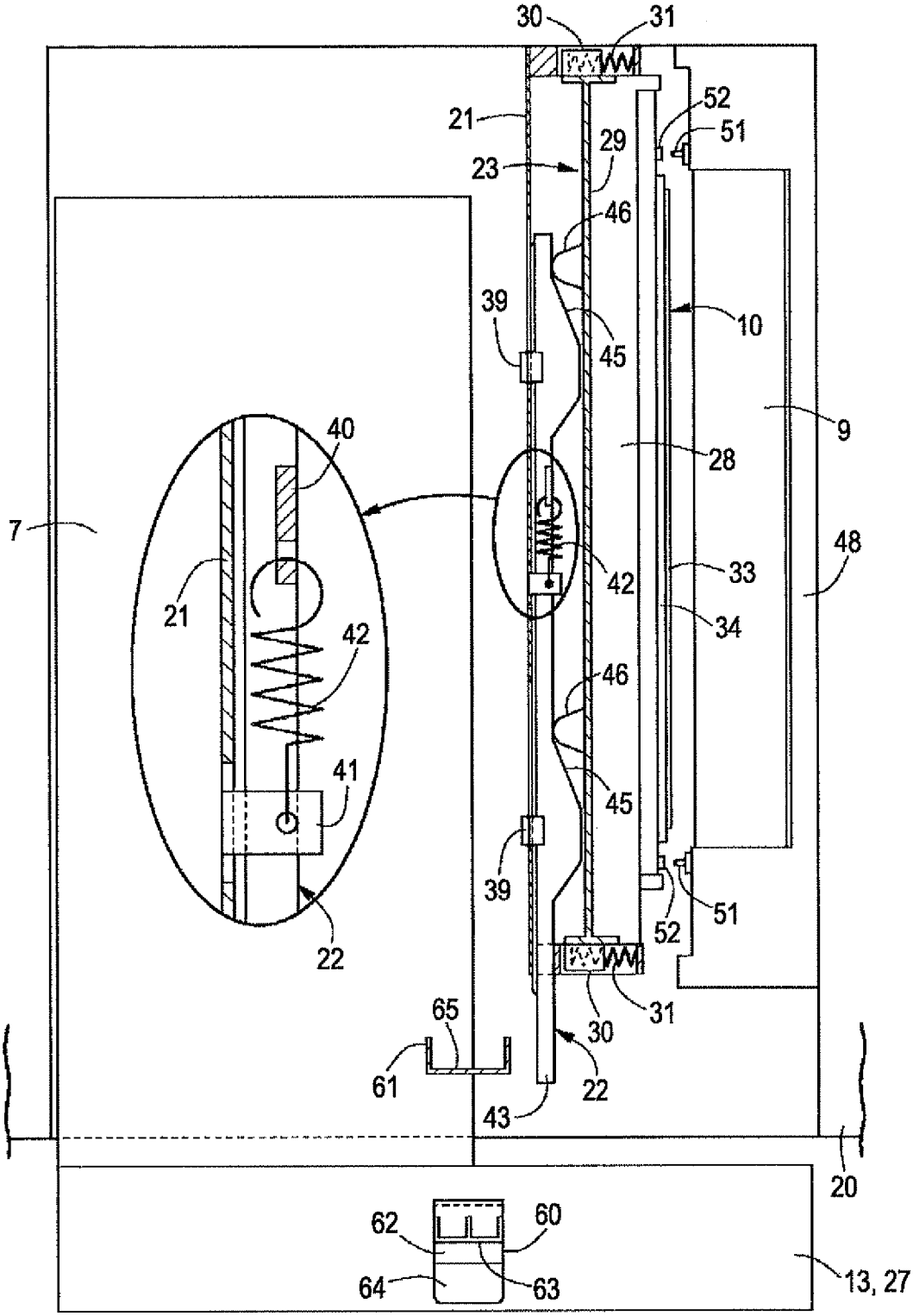
FIG. 1 is a plan view of a head moving structure of an image forming device according to an embodiment of the present invention.

The slide frame 22 is configured by a frame body having a reverse E-shaped cross-section, a pair of upper and lower slide claws 39 are arranged on left side surfaces at two areas on the front and back of the slide frame 22, and a spring holding piece 40 is integrally arranged on an upper surface of the slide frame 22 between the slide claws 39 (see FIG. 1). The slide frame 22 includes a slide rib 38 that slidably moves along the inner surface of the side wall of the fixed frame 21 (see FIG. 5). When the slide claw 39 is guided by the frame guiding groove 26 and the slide rib 38 is guided by the inner surface of the side wall of the fixed frame 21, the slide frame 22 slides to the front and the back in a direction parallel to a center axis line of the photosensitive drum 9. The slide frame 22 thus can stably move between a standby position on the front side and an operating position on the back side. In order to bias the slide frame 22 towards the standby position, a second spring 42 (biasing member) of helical extension type is held between a spring holding piece 41 arranged on the inner surface of the side wall of the fixed frame 21 and the spring holding piece 40 (see FIG. 1). The front end of the slide frame 22 is configured as a passive portion 43. The passive portion 43 is pushed by the waste toner box 13 when the toner cartridge 7 and the waste toner box 13 are loaded inside the main body 1. The details thereof will be described later.

In order to move the head supporting frame 23 by converting the operation in which the slide frame 22 slides along the first axis line 22A (front and back direction) to the sliding operation along the second axis line 23A (left and right direction), a cam structure is arranged between the slide frame and the head supporting frame 23 (cam base 29) (opposing surface to which the slide frame 22 and the head supporting frame 23 oppose). The cam structure is configured by a pair of front and back operation cams 45 arranged in a projecting manner on the slide frame 22, and a pair of front and back passive cams 46 arranged in a projecting manner on the cam base 29 (see FIG. 4). The operation cam 45 is formed to an isosceles trapezoid shape, and the passive cam 46 is formed to a triangular shape with rounded vertices. The cams 45, 46 are alternately arranged to reduce the space occupied by the operation cam 45 and the passive cam 46 at the separated position. Specifically, the operation cam 45 and the passive cam 46 are alternately arranged with the projecting end of the operation cam 45 at the separated position arranged proximate to the cam base 29, and the projecting end of the passive cam 46 at the separated position received by the slide frame 22 continuing to the base bottom portion of the operation cam 45.

The operation body 27 (waste toner box 13) slides the slide frame 22 to move the exposure head 10 supported by the head supporting frame 23 between the separated position and the proximate position with respect to the photosensitive drum 9. In other words, the operation body 27 slides the slide frame 22 to move the exposure head 10 from one side to the other side of the separated position and the proximate position. The operation body 27 moves to one side the exposure head 10 that has been moved to the other side. When the slide frame 22 is slid, the contacting mode of the operation cam 45 and the passive cam 46 changes, and thus the exposure head 10 supported by the head supporting frame 23 is moved from one side to the other side of the separated position and the proximate position with respect to the photosensitive drum 9. The change in the contacting mode includes change in the contacting position, or the switch between the contacting state and the non-contacting state.

Figure 8:
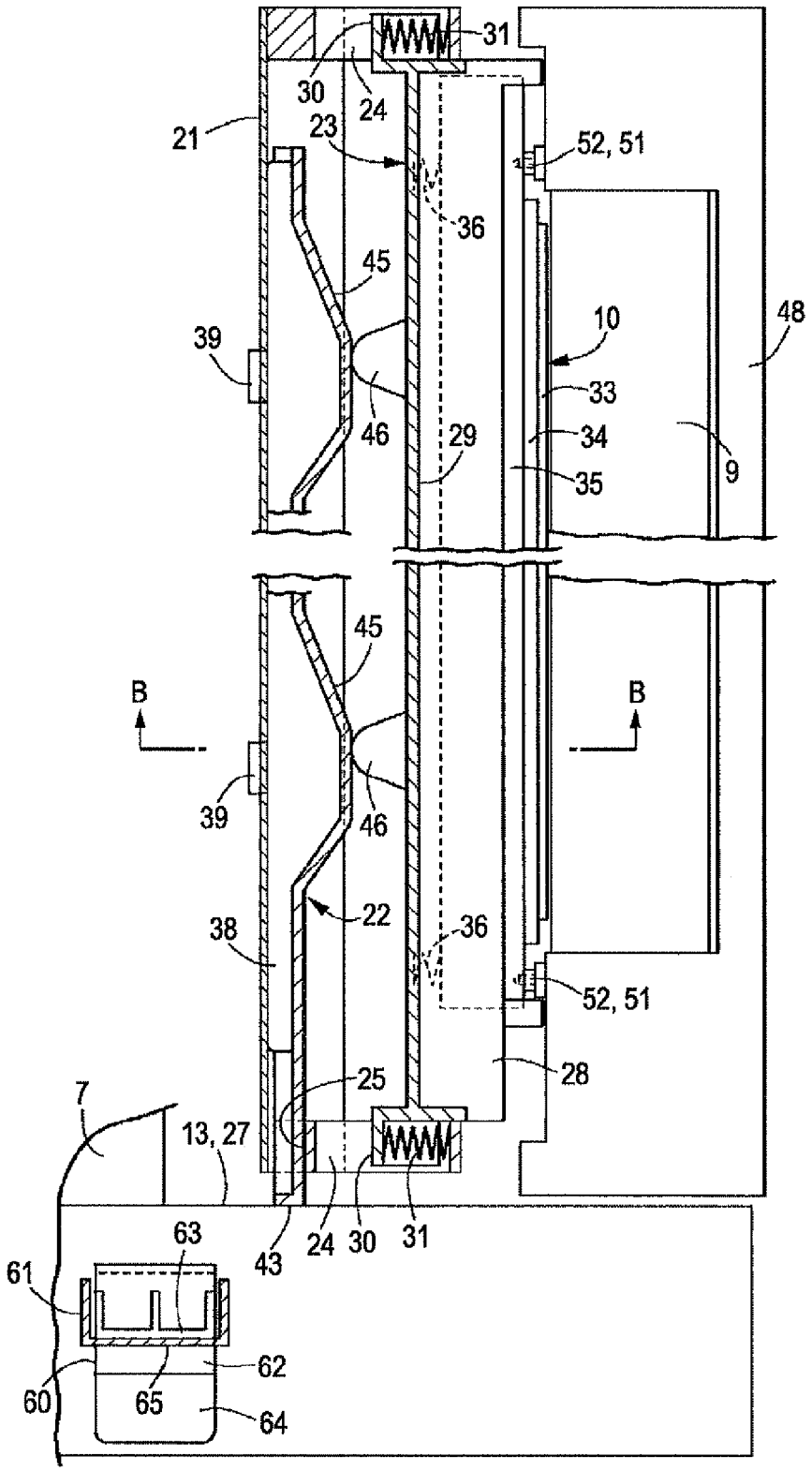
FIG. 8 is a plan view of the head moving structure in a state where the exposure head is at a proximate position in the embodiment of the present invention.

When the slide frame 22 is pushed backward against the biasing force of the second spring 42, the projecting end of the passive cam 46 is gradually pushed towards the photosensitive drum 9 with the inclined surface portion of the operation cam 45, and the head supporting frame 23 is moved towards the proximate position against the biasing force of the first spring 31. As illustrated in FIG. 8, when the projecting end of the passive cam 46 abuts on a flat projecting end face of the operation cam 45, the head supporting frame 23 is switched to the proximate position, and the lens array 33 of the exposure head 10 faces the peripheral surface of the photosensitive drum 9 by way of a very small gap.

Figure 7:
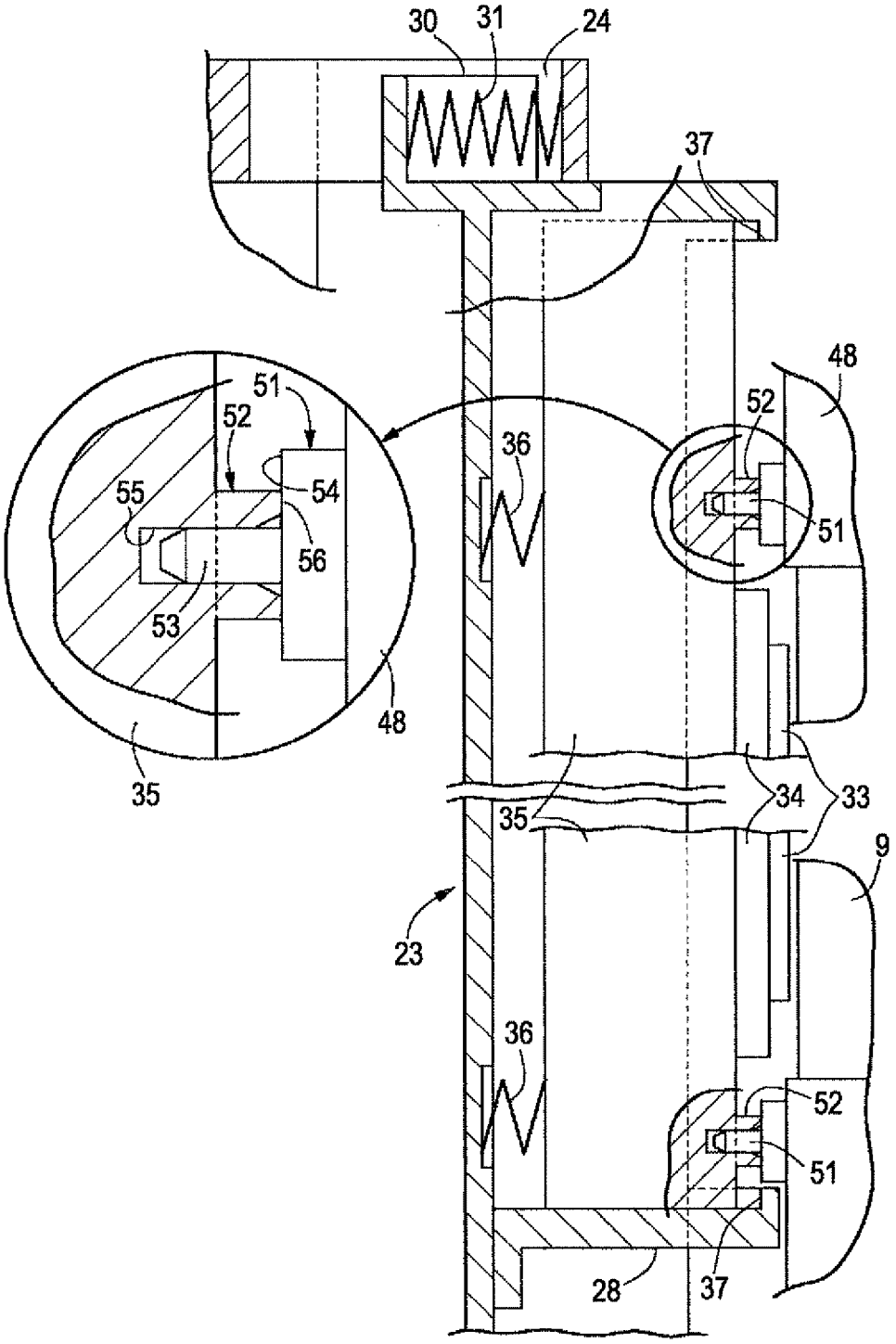
FIG. 7 is a partially broken plan view illustrating details of a positioning structure in the embodiment of the present invention.

At the proximate position, a positioning structure is arranged on a drum supporting frame 48 for supporting the photosensitive drum 9 and the head base 35 to position the exposure head 10 front and back, left and right, and up and down with the photosensitive drum 9 as a position reference. Specifically, the positioning structure is arranged on the front side and the back side in the front and back direction on the opposing surface opposing the head base 35 in the drum supporting frame 48 and the opposing surface opposing the drum supporting frame 48 in the head base 35. The positioning structure is configured by a positioning shaft 51 and a positioning boss 52. As illustrated in FIG. 7, the positioning shaft 51 includes a positioning pin 53 and a first positioning seat 54, and the positioning boss 52 includes a positioning hole that engages with the positioning pin 53 and a second positioning seat 56. In the embodiment, the positioning shaft is arranged on the drum supporting frame 48, and the positioning boss 52 is arranged on the head base 35. As a result of engaging the positioning pin 53 and the positioning hole 55, the first and second positioning seats 54, 56 are joined thus appropriately positioning the exposure head 10.

To position the exposure head 10 while avoiding the influence of when the dimensional error and the like of each member in the slide frame 22, the cam structure, the head supporting frame 23, and the like are accumulated, the head base is supported in a freely sliding manner by the housing 28, and the exposure head 10 is biased in a direction of advancing towards the photosensitive drum 9 by the third spring 36. For example, if the position of the exposure head 10 is projected out towards the photosensitive drum 9 more than the standard position due to the accumulated error of each member mentioned above, the opposing distance of the lens array 33 and the photosensitive drum 9 becomes small and the electrostatic latent image may not be correctly imaged. However, as previously described, if the head base 35 is positioned with respect to the drum supporting frame 48 by the positioning structure, the opposing spacing of the lens array 33 and the photosensitive drum 9 can be maintained at an appropriate spacing by joining the first and second positioning seats 54, 56. Furthermore, the accumulated error can be alleviated by slidably moving the head supporting frame 23 with respect to the positioned exposure head 10 even if there is an accumulated error. Moreover, when the slide frame 22 is violently pushed, the impact can be absorbed as the head supporting frame 23 slides with respect to the exposure head 10.

Figure 9:
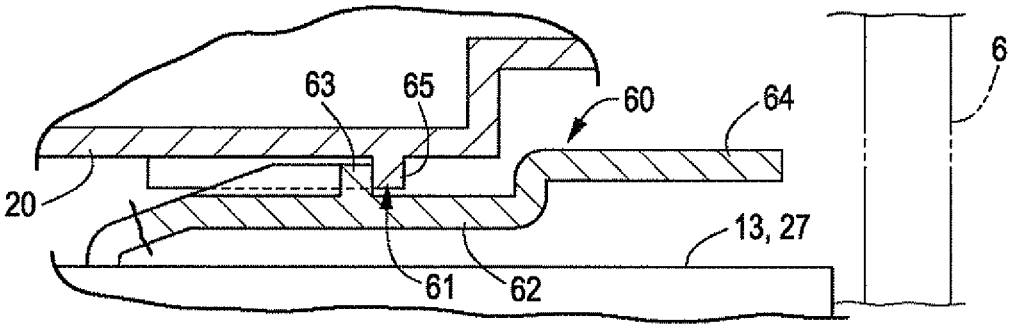
FIG. 9 is a longitudinal side view illustrating a holding structure for holding a loaded state of a toner container in the embodiment of the present invention.

A holding structure is arranged between the waste toner box 13 and the chassis 20 to hold the toner cartridge 7 and the waste toner box 13 in a state of being inserted and loaded to the loaded position at the left side part and the front part of the developing unit 8. As illustrated in FIG. 9, the holding structure is configured by a first engagement body 60 arranged on the upper surface of the waste toner box 13 and a second engagement body 61 arranged on the chassis 20 side.

The first engagement body 60 integrally includes a cantilever elastic arm 62 integrally formed with the waste toner box 13, an engagement projection 63 arranged in a projecting manner on an upper surface of the elastic arm 62, and a releasing portion 64 of a projecting end of the elastic arm 62. The engagement projection 63 is formed in an E-shape when seen from the upper surface side, and the front surface of the front wall thereof engages with the second engagement body 61. The second engagement body 61 is made of a gate-shaped rib when seen from the upper surface side, and an engagement wall 65 on the front side thereof engages with the engagement projection 63 to regulate the forward movement of the waste toner box 13. When detaching the toner cartridge 7 and the waste toner box 13, the front door 6 is opened, and then the releasing portion 64 is pushed down to elastically deform the entire elastic arm 62 downward. Thus, the engagement of the engagement projection 63 and the engagement wall 65 is released so that the engagement bodies 60, 61 can be separated, and the waste toner box 13 can be pulled out towards the front side while maintaining such a state.

In a state where the waste toner box 13 (operation body 27) is detached from the loaded position, the slide frame 22 is returned with the second spring 42 to move to the standby position illustrated in FIGS. 1 and 4. In this case, the passive portion 43 of the slide frame 22 is advanced to an attachment region occupied by the waste toner box 13, and the head supporting frame 23 and the exposure head 10 are positioned at the separated position.

Next, an operation of the head moving structure when loading the new toner cartridge 7 and the waste toner box 13 to the loaded position will be described. In a state where the waste toner box 13 is loaded to the loaded position as illustrated in FIG. 1, the wall surface on the back side thereof approaches the slide frame 22 while facing the passive portion 43. When the waste toner box 13 is loaded up to near the terminating end of the loading stroke, the wall surface on the back side of the waste toner box 13 makes contact with the passive portion 43 and thus pushes the slide frame 22 backward against the biasing force of the second spring 42. The passive cam 46 is gradually pushed by the operation cam 45 in cooperation with such a pushing operation, and thus the head supporting frame 23 moves towards the proximate position against the biasing force of the first spring 31. Furthermore, in a state where the waste toner box 13 is pushed up to the terminating end of the loading stroke, the projecting end of the passive cam 46 abuts on the flat projecting end face of the operation cam 45 as illustrated in FIG. 8, and the head supporting frame 23 and the exposure head 10 are switched to the proximate position. In a course of the waste toner box 13 being loaded to the loaded position (detached from the loaded position), the contacting mode of the operation cam 45 and the passive cam 46 is sequentially fluctuated, and hence the positions of the head supporting frame 23 and the exposure head 10 fluctuate.

The positioning pin 53 and the positioning hole 55 are engaged in parallel with the switching of the exposure head 10 to the proximate position, and the exposure head 10 is positioned front and back, and up and down. Furthermore, the first and second positioning seats 54, 56 are brought into contact with each other to position the exposure head 10 in the left and right direction with respect to the photosensitive drum 9. After the elastic arm 62 of the first engagement body 60 arranged on the waste toner box 13 is passed through the lower surface of the engagement wall 65 of the second engagement body while elastically deforming, the engagement projection 63 enters the inner surface of the rib of the second engagement body 61 and engages the engagement wall 65 thus fixing the waste toner box 13.

According to the head moving structure configured as above, the head moving structure is configured by the fixed frame 21, the slide frame 22, the head supporting frame 23, the cam structure for performing operation conversion, the operation body 27, and the like, and thus the number of components can be reduced and the overall structure can be simplified compared to the conventional head moving structure. Since all the configuring parts can be assembled to the fixed frame 21 in advance to form a unit, the trouble of assembly can be alleviated compared to the conventional head moving structure, and the structure can be simplified as described above. As a result, the cost required to manufacture the head moving structure can be reduced as a whole. Furthermore, since the other configuring parts are aggregated with respect to the fixed frame 21, the amount of space occupied by the head moving structure inside the chassis 20 can be reduced. Since the head supporting frame 23 is slidably moved in the left and right direction by converting the front and back sliding operation of the slide frame 22 to the sliding operation in the left and right direction with the cam structure, the operation direction can be changed at one time, and the reliability can be improved by that much. In the conventional transmitting structure, the direction of the opening/closing operation of the front door is changed with the operation projection and the operation arm, and the wire and the guide pulley, and then transmitted to the exposure head through the pressing lever, and thus the operation direction is changed many times and the possibility of breakdown becomes high by that much.

FIGS. 10-13 each illustrates another embodiment of the head moving structure. In such embodiments, the portion different from the previously described embodiment will be mainly described, and the same reference numerals are denoted on the same members as the previously described embodiment and the description thereof will be omitted.

Figure 10:
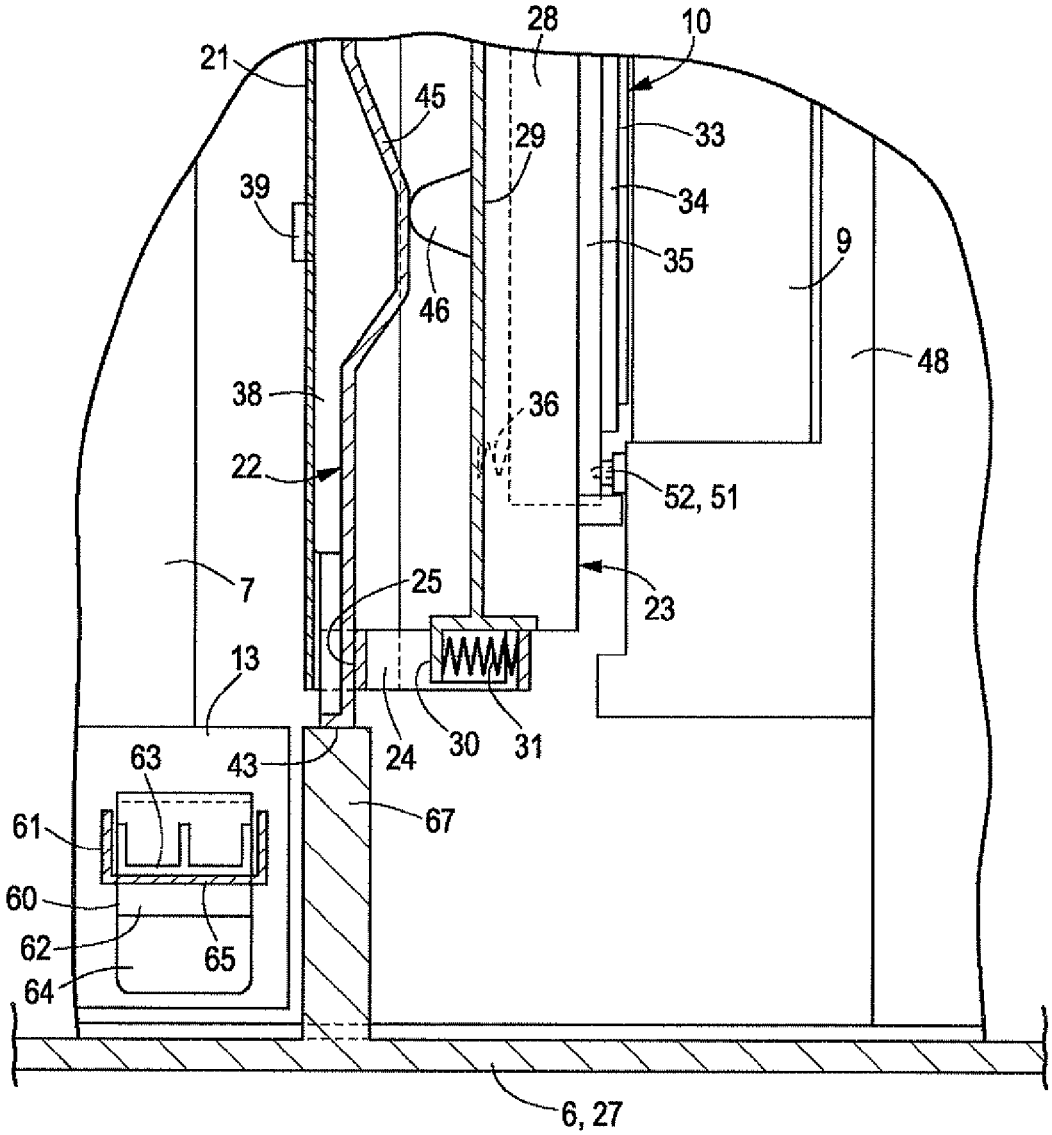
FIG. 10 is a plan view illustrating another embodiment of the head moving structure.

In the head moving structure illustrated in FIG. 10, the slide frame 22 can be pushed by using the front door 6 supported in a freely opening/closing manner for the operation body 27. To this end, an operation projection 67 is arranged on the inner surface of the front door 6, so that when the front door 6 is closed, the operation projection 67 pushes the slide frame 22 to move the exposure head 10 to the proximate position. The photosensitive drum 9, the exposure head 10, the waste toner box 13, and the like are arranged inside the front door 6, and such components can be replaced, subjected to inspection, and the like by opening the front door 6.

Figure 11:
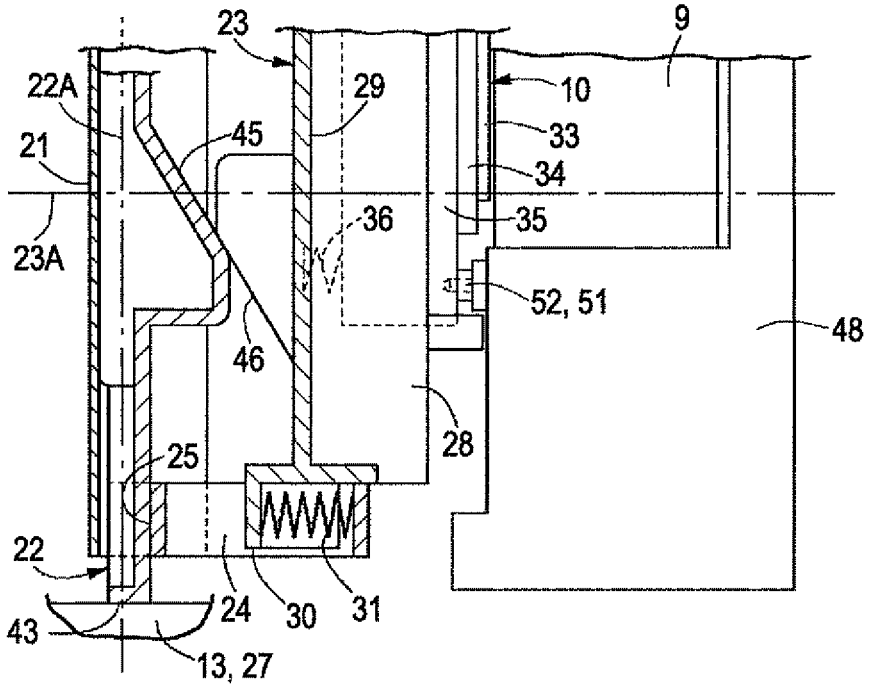
FIG. 11 is a plan view illustrating a further embodiment of the head moving structure.

One part of the cam structure is changed in the head moving structure illustrated in FIG. 11. Specifically, the operation cam 45 and the passive cam 46 are respectively provided with an inclined surface cam, and the head supporting frame 23 and the exposure head 10 can be moved from the separated position to the proximate position with the inclined cam surfaces of the cams 45, 46 always making contact with each other.

Figure 12:
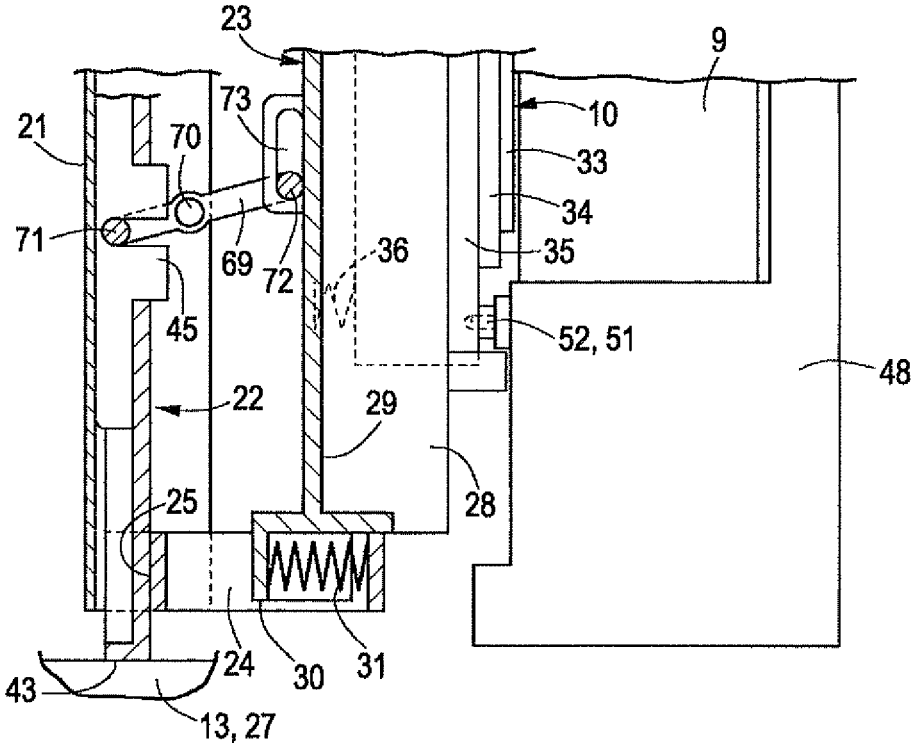
FIG. 12 is a plan view illustrating a further embodiment of the head moving structure.

In the head moving structure illustrated in FIG. 12, a groove cam (operation cam) 45 that is long in the left and right direction arranged in the slide frame 22 and a lever 69 for converting the sliding operation in the front and back direction of the groove cam 45 to the left and right operation perform the operation conversion between the slide frame 22 and the head supporting frame 23. To this end, a middle part of the lever 69 is supported in a front and back oscillating manner with a lever shaft 70 arranged on the fixed frame 21, where a lever arm 71 at one end is engaged with the groove cam 45 and a lever arm 72 at the other end is engaged with a passive groove 73 formed in the head supporting frame 23. The passive groove 73 is provided with a long groove in the front and back direction. In this head moving structure, when pushing the slide frame 22 and moving the head supporting frame 23 from the separated position to the proximate position, the movement amount of the head supporting frame 23 in the vicinity of the separated position is large and the movement amount of the head supporting frame 23 becomes smaller towards the proximate position. Therefore, the positioning by the positioning shaft 51 and the positioning boss 52 can be slowly and accurately carried out.

Figure 13:
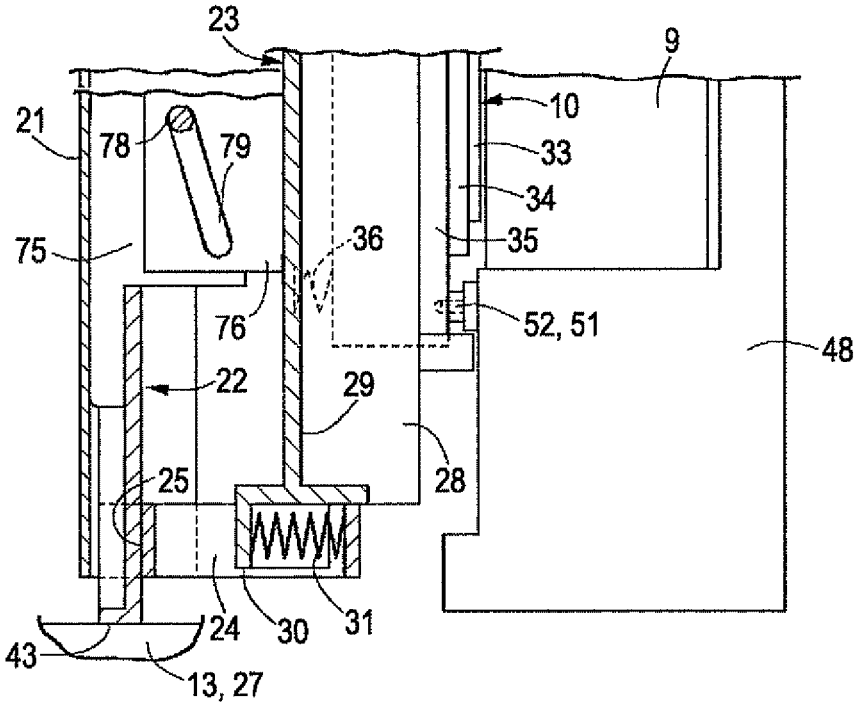
FIG. 13 is a plan view illustrating a further embodiment of the head moving structure.

In the head moving structure illustrated in FIG. 13, a projection cam 75 is arranged on the slide frame 22 and a groove cam 76 is arranged on the head supporting frame 23, and the projection cam 75 and the groove cam 76 perform the operation conversion between the slide frame 22 and the head supporting frame 23. More specifically, a projection body 78 is formed on the projection cam 75, and a longitudinal groove 79 is formed in an inclined manner in the groove cam 76. The projection body 78 is configured to be movable in the longitudinal direction while being engaged with the groove 79. Thus, in this head moving structure, by pushing the slide frame 22 towards the back side, the projection body 78 pushes the head supporting frame 23 from the separated position towards the proximate position through the groove cam 76 while moving along the groove 79. The position relationship of the projection body 78 and the groove 79 illustrated in FIG. 13 is a relationship of when the exposure head is at the proximate position. When the head supporting frame 23 is moved from the proximate position to the separated position, the projection body 78 pulls the head supporting frame 23 in the separating direction through the groove cam 76 while moving from the position illustrated in FIG. 13 towards the front side. Thus, in the head moving structure illustrated in FIG. 13, the slide frame 22 and the head supporting frame 23 are maintained in a coupled state regardless of the sliding operation of the slide frame 22 by the projection cam 75 (projection body 78) and the groove cam 76 (groove 79), and thus the power can be transmitted on a constant basis between the slide frame 22 and the head supporting frame 23. Therefore, the first spring 31 and the second spring 42 (biasing member) can be omitted.

In each embodiment described above, the toner cartridge (toner container) 7 can be used in place of the waste toner box 13, or a developing unit (toner container) 8 can be used as the operation body 27 for pushing the slide frame 22 towards the back side.

In the embodiment described above, the sliding operation in the front and back direction of the slide frame 22 is converted to the sliding operation in the left and right direction of the head supporting frame 23 with the cam structure, but the present invention is not limited thereto. That is, the head supporting frame 23 can be supported in a slidable manner in an arbitrary direction that intersects the front and back sliding direction of the slide frame 22. For example, the head supporting frame 23 can be supported in a diagonally inclined state so that the sliding direction is directed towards the center of the photosensitive drum 9, and the sliding operation in the front and back direction of the slide frame 22 can be converted to the diagonal reciprocate sliding operation of the head supporting frame 23. In the embodiment described above, the slide frame 22 is slid in the front and back direction, but the present invention is not limited thereto. For example, the slide frame 22 may be slid in the left and right direction. The intersecting arbitrary direction described above includes an arbitrary orthogonal direction and an arbitrary inclined direction with respect to the sliding direction of the slide frame 22, that is, a direction that is not parallel to the sliding direction of the slide frame 22.

A drum unit may be configured including the photosensitive drum 9, the drum supporting frame 48, and the positioning shaft 51. The drum unit is attached in a freely attaching and detaching manner to the chassis 20 at the attachment position distant with respect to the door 6 than the waste toner box 13.

The door 6 does not need to be a front door, and may be a door arranged on the side surface or the back surface of the main body 1 as long as it is a door arranged facing the exposure head 10. The outer shape of the operation cam 45 and the passive cam 46 can be freely changed as necessary, and thus is not limited to the structure described in the embodiment. The operation body 27 may be a dedicated lever or a handle arranged on the main body 1.

The embodiments of the present invention described above have the following advantages. The head moving structure is configured by the fixed frame 21, the slide frame 22 supported in a slidable manner in a direction intersecting each other at the fixed frame 21, the head supporting frame 23, the cam structure arranged between the frames 22, 23, the operation body 27 for sliding the slide frame 22, and the like. According to the head moving structure in which the operation conversion between the slide frame 22 and the head supporting frame 23 is carried out with the cam structure, the number of configuring parts can be reduced and the entire structure can be simplified compared to the conventional head moving structure. Thus, the cost required to manufacture the head moving structure can be reduced. The operation conversion structure can also be simplified compared to the conventional structure in which the operation conversion is carried out with a plurality of levers, a wire, a direction changing pulley, and the like. Since the slide frame 22, the head supporting frame 23, the cam structure, and the like are arranged in an aggregated state in the fixed frame 21, the head moving structure can be made compact and the amount of space occupied by the head moving structure inside the main body 1 can be reduced.

The embodiments of the present invention described above have the following additional advantages. According to the head moving structure using the waste toner box (toner container) 13 as the operation body 27, the slide frame 22 is sled front and back in cooperation with the operation of attaching and detaching the waste toner box 13 to automatically move the exposure head 10 between the separated position and the proximate position. Therefore, the user does not need to manually carry out the position adjustment of the exposure head 10 after replacing the waste toner box 13, and the trouble of the user in replacing the waste toner box 13 can be reduced. In the loading operation of the waste toner box 13, the user can visually recognize the operation leakage, and thus the operation leakage related to the loading of the waste toner box 13 and the movement of the exposure head 10 can be prevented by moving the exposure head 10 in cooperation with the loading operation of the waste toner box 13.

The embodiments of the present invention described above have the following additional advantages. According to the head moving structure using the door 6 as the operation body 27, the exposure head 10 can be automatically moved between the separated position and the proximate position with the slide frame 22 that slides in cooperation with the opening/closing operation of the door 6. Furthermore, with the use of the door 6, in which the open/close state can be definitely determined at a glance, as the operation source of the head moving structure, the exposure head 10 is prevented from being left in a state positioned at the separated position by mistake or assumption, and the improper use of the image forming device can be prevented.

The embodiments of the present invention described above have the following additional advantages. When the exposure head 10 is moved and biased towards the separated position with the first spring 31, the exposure head 10 can be returned from the proximate position to the separated position in a state where the operation force of the operation body 27 with respect to the slide frame 22 is opened. When the slide frame 22 is moved and biased towards the operation body 27 with the second spring 42, the passive portion 43 of the slide frame is advanced and moved to the attachment region of the operation body 27 to be held in the standby state in a state where the operation force of the operation body 27 with respect to the slide frame 22 is opened. Therefore, when performing maintenance of the inside of the main body 1 or replacing the waste toner box 13, the trouble of the user to manually switch the slide frame 22 to the standby state can be omitted, or the trouble of manually moving the exposure head 10 to the separated position can be omitted, thereby reducing the work load.

The embodiments of the present invention described above have the following additional advantages. If the positioning structure is arranged on the opposing surfaces of the drum supporting frame 48 and the head base 35, the exposure head 10 in a state moved to the proximate position can be appropriately positioned with respect to the photosensitive drum 9, which becomes the position reference. Therefore, although it is a head moving structure in which the exposure head 10 moves between the separated position and the proximate position, the position relationship of the exposure head 10 and the photosensitive drum 9 can always be maintained in an appropriate state to accurately carry out the formation of the latent image with respect to the photosensitive drum 9.

The embodiments of the present invention described above have the following additional advantages. If the holding structure including the first engagement body 60 and the second engagement body 61 is arranged between the waste toner box 13 and the chassis 20 accommodating the waste toner box 13, the loaded state of the waste toner box 13 can be continued to be held unless the engagement state of the engagement bodies 60, 61 is released. The exposure head 10 can be continued to be held at the proximate position while maintaining the position of the slide frame 22 pushed with the waste toner box 13. Therefore, the head moving structure can be prevented from being unnecessarily operated such as the exposure head 10 moving from the proximate position to the separated position every time the door 6 is opened for maintenance, and the wear of the slidably moving components configuring the head moving structure can be prevented. In the embodiment of the present invention described above, the photosensitive drum is used for the photosensitive body, but a photosensitive belt may also be used.

While the present invention has been described with respect to embodiments thereof, it will be apparent to those skilled in the art that the disclosed invention may be modified in numerous ways and may assume many embodiments other than those specifically set out and described above. Accordingly, the appended claims cover all modifications that fall within the true spirit and scope of the present invention.

What is claimed is:

1. An image forming device comprising:

a fixed frame fixed to a chassis and arranged adjacent to a photosensitive body;

a slide frame supported in a slidable manner along a first axis line by the fixed frame;

a head supporting frame for supporting an exposure head, the head supporting frame being supported in a slidable manner along a second axis line, which intersects the first axis line, by the fixed frame;

a cam structure for converting an operation in which the slide frame slides along the first axis line to an operation in which the head supporting frame slides along the second axis line; and a toner container that is freely attachable to and detachable from the chassis, the toner container moving the exposure head supported by the head supporting frame between a separated position and a proximate position with respect to the photosensitive body by sliding the slide frame by being attached to or detached from the chassis, wherein the exposure head is moved to the proximate position with respect to the photosensitive body when the toner container is attached to the chassis.

2. The image forming device according to claim 1, further comprising:

a first biasing member, arranged between the fixed frame and the head supporting frame, for biasing the head supporting frame towards the separated position; and a second biasing member, arranged between the fixed frame and the slide frame, for biasing the slide frame towards the toner container such that one part of the slide frame advances into an attachment region occupied by the toner container in a state where the toner container is detached from the chassis.

3. The image forming device according to claim 1, wherein the exposure head includes a lens array and an LED light source, and a head base for supporting both the lens array and the LED light source, the head base is supported on a side facing the photosensitive body in the head supporting frame, and a positioning structure is arranged on opposing surfaces of a supporting frame for supporting the photosensitive body and the head base to position the exposure head with respect to the photosensitive body at the proximate position by being engaged.

4. The image forming device according to claim 3, further comprising a third biasing member for biasing the exposure head towards the photosensitive body.

5. The image forming device according to claim 4, wherein the head supporting frame includes a housing for supporting the head base in a freely sliding manner.

6. The image forming device according to claim 1, further comprising a holding structure, arranged between the toner container and the chassis, for holding an attached state of the toner container, wherein the holding structure includes a first engagement body arranged on the toner container side, and a second engagement body arranged on the chassis side; and the first engagement body is engaged with the second engagement body to regulate forward movement of the toner container, and the first engagement body is released from engagement with the second engagement body to enable reverse movement of the toner container.

7. The image forming device according to claim 1, wherein the cam structure is arranged between the slide frame and the head supporting frame.

8. The image forming device according to claim 7, wherein the cam structure includes an operation cam arranged in a projecting manner on the slide frame, and a passive cam arranged in a projecting manner on the head supporting frame; and when the exposure head is at the separated position, a projecting end of the operation cam is arranged proximate to the head supporting frame, and a projecting end of the passive cam is received by the slide frame continuing to a basal end of the operation cam.

9. The image forming device according to claim 8, wherein the operation cam is provided with an inclined surface inclined with respect to the first axis line;

the passive cam is provided with an inclined surface inclined with respect to the second axis line; and the exposure head moves between the separated position and the proximate position with the respective inclined surfaces of the operation cam and the passive cam brought into contact with each other.

10. The image forming device according to claim 1, further comprising:

a door supported in a freely opening/closing manner by the chassis; and a drum unit attached to the chassis in a freely attaching and detaching manner so as to be arranged distant with respect to the door than the toner container, the drum unit including a photosensitive drum serving as the photosensitive body, a drum supporting frame for supporting the photosensitive drum, and a positioning shaft for positioning the exposure head with respect to the photosensitive drum at the proximate position.

11. The image forming device according to claim 1, further comprising:

a first biasing member, arranged between the fixed frame and the head supporting frame, for biasing the head supporting frame towards the separated position;

a second biasing member, arranged between the fixed frame and the slide frame, for biasing the slide frame towards the toner container such that one part of the slide frame advances into an attachment region occupied by the toner container in a state where the toner container is detached from the chassis; and a holding structure, arranged between the toner container and the chassis, for holding an attached state of the toner container, wherein the holding structure includes a first engagement body arranged on the toner container side, and a second engagement body arranged on the chassis side; and the first engagement body is engaged with the second engagement body to regulate forward movement of the toner container, and the first engagement body is released from engagement with the second engagement body to enable reverse movement of the toner container.

12. An image forming device comprising:

a fixed frame fixed to a chassis and arranged adjacent to a photosensitive body;

a slide frame supported in a slidable manner along a first axis line by the fixed frame;

a head supporting frame for supporting an exposure head, the head supporting frame being supported in a slidable manner along a second axis line, which intersects the first axis line, by the fixed frame;

a cam structure, arranged between the slide frame and the head supporting frame, for converting an operation in which the slide frame slides along the first axis line to an operation in which the head supporting frame slides along the second axis line; and a toner container that is freely attachable to and detachable from the chassis, the toner container moving the exposure head supported by the head supporting frame from one side to the other side of a separated position and a proximate position with respect to the photosensitive body by sliding the slide frame by being attached to and detached from the chassis, wherein the exposure head is moved to the proximate position with respect to the photosensitive body when the toner container is attached to the chassis.

13. The image forming device according to claim 12, further comprising:

a first biasing member, arranged between the fixed frame and the head supporting frame, for biasing the head supporting frame towards the separated position;

a second biasing member, arranged between the fixed frame and the slide frame, for biasing the slide frame towards the toner container such that one part of the slide frame advances into an attachment region occupied by the toner container in a state where the toner container is detached from the chassis; and a holding structure, arranged between the toner container and the chassis, for holding an attached state of the toner container, wherein the holding structure includes a first engagement body arranged on the toner container side, and a second engagement body arranged on the chassis side; and the first engagement body is engaged with the second engagement body to regulate forward movement of the toner container, and the first engagement body is released from engagement with the second engagement body to enable reverse movement of the toner container.

14. An image forming device comprising:

a fixed frame fixed to a chassis and arranged adjacent to a photosensitive body;

a slide frame supported in a slidable manner along a first axis line by the fixed frame;

a head supporting frame for supporting an exposure head, the head supporting frame being supported in a slidable manner along a second axis line, which intersects the first axis line, by the fixed frame;

a passive cam arranged in a projecting manner on the head supporting frame;

an operation cam arranged in a projecting manner on the slide frame and brought into contact with the passive cam; and a toner container that is freely attachable to and detachable from the chassis, the toner container changing a contacting mode of the operation cam and the passive cam by sliding the slide frame by being attached to and detached from the chassis, and moving the exposure head supported by the head supporting frame from one side to the other side of a separated position and a proximate position with respect to the photosensitive body by changing the contacting mode, wherein the exposure head is moved to the proximate position with respect to the photosensitive body when the toner container is attached to the chassis.

15. The image forming device according to claim 14, further comprising:

a first biasing member, arranged between the fixed frame and the head supporting frame, for biasing the head supporting frame in a direction away from the photosensitive body; and a second biasing member, arranged between the fixed frame and the slide frame, for biasing the slide frame towards the toner container such that one part of the slide frame advances into an attachment region occupied by the toner container in a state where the toner container is detached from the chassis.

16. The image forming device according to claim 14, further comprising:

a first biasing member, arranged between the fixed frame and the head supporting frame, for biasing the head supporting frame towards the separated position;

a second biasing member, arranged between the fixed frame and the slide frame, for biasing the slide frame towards the toner container such that one part of the slide frame advances into an attachment region occupied by the toner container in a state where the toner container is detached from the chassis; and a holding structure, arranged between the toner container and the chassis, for holding an attached state of the toner container, wherein the holding structure includes a first engagement body arranged on the toner container side, and a second engagement body arranged on the chassis side; and the first engagement body is engaged with the second engagement body to regulate forward movement of the toner container, and the first engagement body is released from engagement with the second engagement body to enable reverse movement of the toner container.

* * * * *